US011286657B2

(12) United States Patent
Rysak

(10) Patent No.: US 11,286,657 B2
(45) Date of Patent: Mar. 29, 2022

(54) HANDHELD SPRAYER ASSEMBLY

(71) Applicant: Charity Rysak, Canton, OH (US)

(72) Inventor: Charity Rysak, Canton, OH (US)

( * ) Notice: Subject to any disclaimer, the term of this patent is extended or adjusted under 35 U.S.C. 154(b) by 121 days.

(21) Appl. No.: 16/788,466

(22) Filed: Feb. 12, 2020

(65) Prior Publication Data

US 2021/0246644 A1 Aug. 12, 2021

(51) Int. Cl.
*E03D 9/08* (2006.01)

(52) U.S. Cl.
CPC ..... *E03D 9/085* (2013.01)

(58) Field of Classification Search
CPC ..... E03D 9/085
USPC ..... 4/448, 678; 137/801
See application file for complete search history.

(56) References Cited

U.S. PATENT DOCUMENTS

| | | | | |
|---|---|---|---|---|
| 5,720,055 | A | 2/1998 | Krist | |
| 6,473,913 | B1 | 11/2002 | Bell, Sr. | |
| 6,941,590 | B2 | 9/2005 | Lim | |
| 6,973,679 | B1 | 12/2005 | Schad | |
| 6,978,492 | B1 | 12/2005 | Francisco | |
| D641,069 | S | 7/2011 | Sabato | |
| 9,809,966 | B2 | 11/2017 | Jones | |
| 2005/0120471 | A1* | 6/2005 | Lim | E03D 9/085 4/448 |
| 2009/0121042 | A1* | 5/2009 | Mitry | E03D 9/085 239/61 |
| 2013/0326803 | A1* | 12/2013 | Maleki | E03D 9/085 4/448 |
| 2014/0107409 | A1* | 4/2014 | Bailey | E03D 9/08 4/443 |
| 2017/0326561 | A1* | 11/2017 | Sharratt | E03C 1/0408 |

FOREIGN PATENT DOCUMENTS

| | | |
|---|---|---|
| WO | WO9716106 | 5/1997 |

* cited by examiner

*Primary Examiner* — Tuan N Nguyen

(57) ABSTRACT

A handheld sprayer assembly for personal hygienic cleansing and general cleaning tasks includes a hose having a first end, which is couplable to a water supply line that supplies water to a tank of a toilet. A spray head is coupled to a second end of the hose. A selector valve is positioned in the spray head and defines an entry chamber and an exit chamber within the interior space. A flow actuator is engaged to the spray head and is operationally coupled to the selector valve. The spray head can be grasped in a hand of a user, positioning the user to selectively actuate the flow actuator to actuate the selector valve. Water then passes from the entry chamber into the exit chamber and is sprayed from the spray head, allowing the user to perform personal hygienic cleansing and general cleaning tasks in proximity to the toilet.

16 Claims, 6 Drawing Sheets

HANDHELD SPRAYER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sprayer assemblies and more particularly pertains to a new sprayer assembly for personal hygienic cleansing and general cleaning.

(2) Description of Related Art Including Information Disclosed Under 37 CFR 1.97 and 1.98

The prior art relates to sprayer assembles. Prior art sprayer assemblies may comprise a hose having a sprayer engaged thereto.

BRIEF SUMMARY OF THE INVENTION

An embodiment of the disclosure meets the needs presented above by generally comprising a hose having a first end, which is configured to be fluidically coupled to a water supply line that supplies water to a tank of a toilet. A spray head is coupled to a second end of the hose. A selector valve is positioned in the spray head and defines an entry chamber and an exit chamber within the interior space. A flow actuator is engaged to the spray head and is operationally coupled to the selector valve. The spray head is configured to be grasped in a hand of a user, positioning the user to selectively actuate the flow actuator to actuate the selector valve. Water then passes from the entry chamber into the exit chamber and is sprayed from the spray head, allowing the user to perform personal hygienic cleansing and general cleaning tasks in proximity to the toilet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
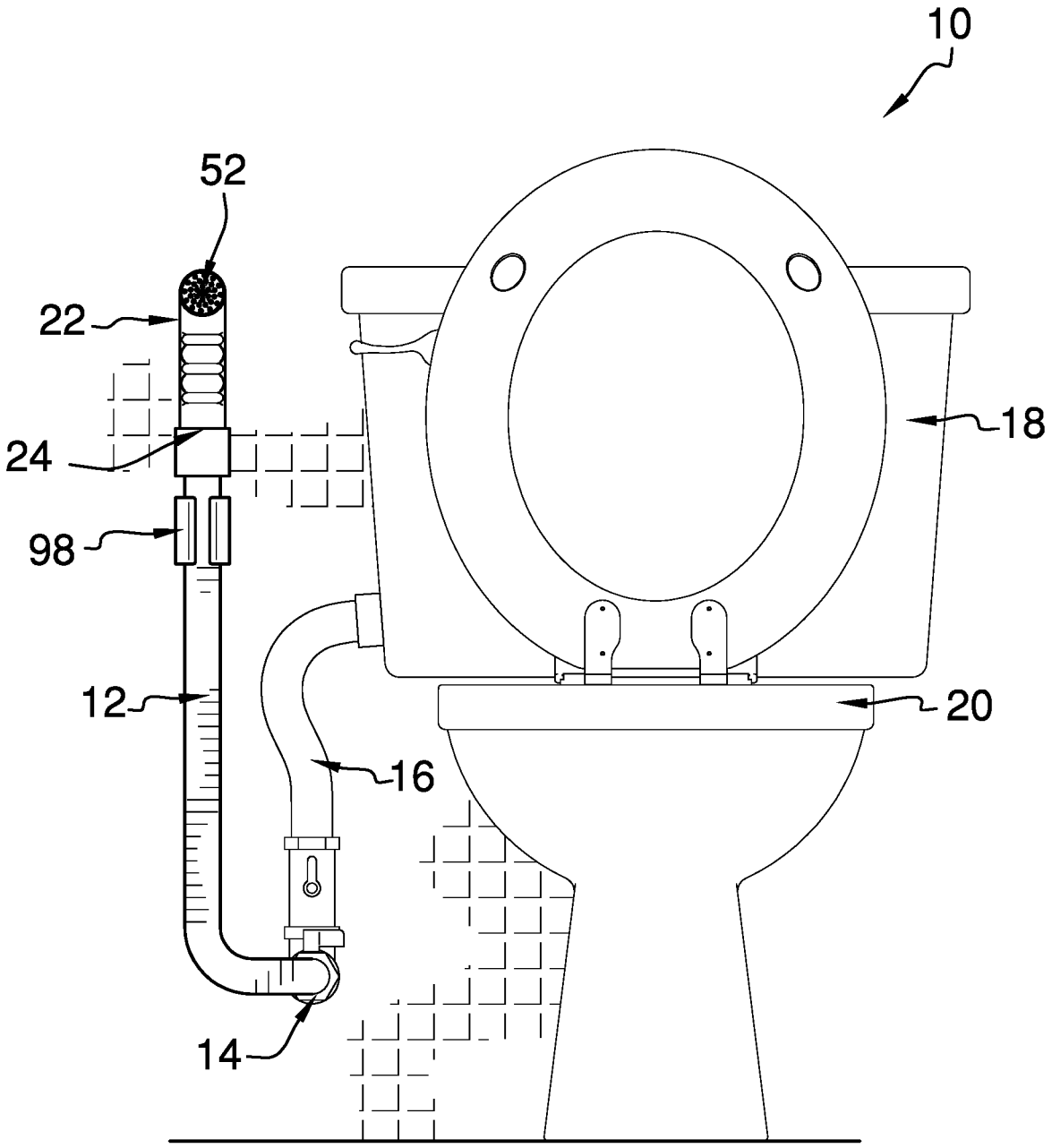
FIG. 1 is an in-use view of a handheld sprayer assembly according to an embodiment of the disclosure.

With reference now to the drawings, and in particular to FIGS. 1 through 6 thereof, a new sprayer assembly embodying the principles and concepts of an embodiment of the disclosure and generally designated by the reference numeral 10 will be described.

As best illustrated in FIGS. 1 through 6, the handheld sprayer assembly 10 generally comprises a hose 12 having a first end 14, which is configured to be fluidically coupled to a water supply line 16 that supplies water to a tank 18 of a toilet 20. A spray head 22 is coupled to a second end 24 of the hose 12. A grip 26 is coupled to the spray head 22 and is configured to enhance a grasp of a hand of a user upon the spray head 22.

Figure 3:
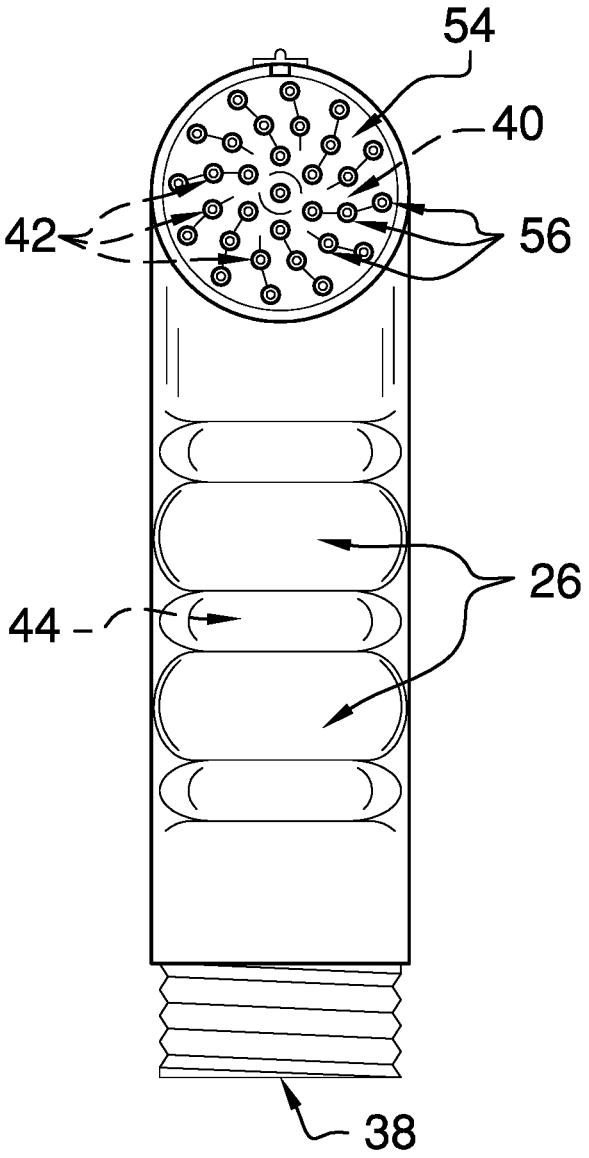
FIG. 3 is a front view of an embodiment of the disclosure.
Figure 6:
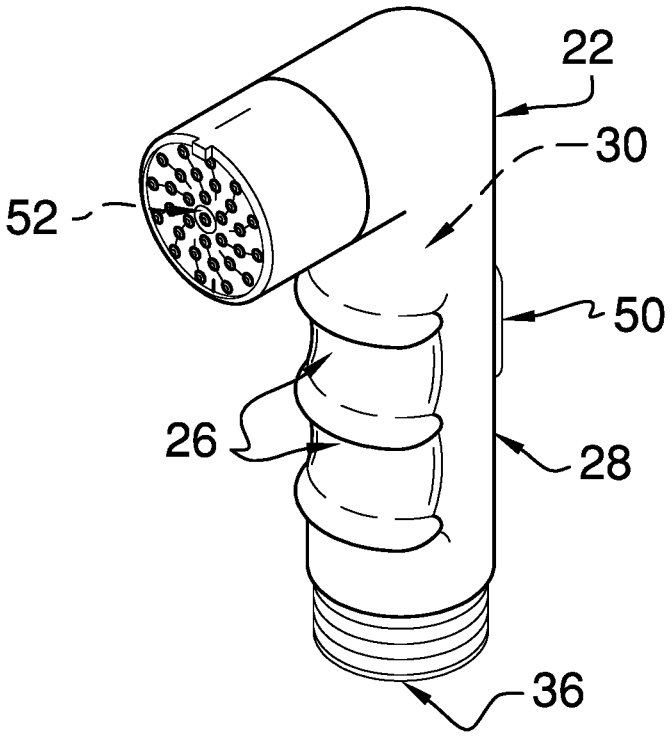
FIG. 6 is an isometric perspective view of an embodiment of the disclosure.

The spray head 22 comprises a shell 28 that defines an interior space 30, as shown in FIG. 6. The shell 28 is tubular and comprises a first section 32 and a second section 34. The second section 34 extends substantially perpendicularly from the first section 32, proximate to a first endpoint 36 of the first section 32. The first section 32 has a second endpoint 38 that is configured to be fluidically coupled to the second end 24 of the hose 12. As shown in FIG. 3, the first section 32 of the shell 28 may be externally threaded adjacent to the second endpoint 38.

The second section 34 has terminus 40 that is distal from the first section 32. The terminus 40 has a plurality of apertures 42 positioned therein. The apertures 42 are configured to generate a spray of water from water that passes through the interior space 30.

A selector valve 44 is positioned in the spray head 22 and defines an entry chamber 46 and an exit chamber 48 within the interior space 30. A flow actuator 50 is engaged to the spray head 22 and is operationally coupled to the selector valve 44. The spray head 22 is configured to be grasped in the hand of the user, positioning the user to selectively actuate the flow actuator 50 to actuate the selector valve 44. Water then passes from the entry chamber 46 into the exit chamber 48 and is sprayed from the spray head 22, allowing the user to perform personal hygienic cleansing and general cleaning tasks in proximity to the toilet 20.

A spray adjuster 52 is positioned in the second section 34 and is configured to selectively alter a characteristic of a spray of water from the spray head 22, such as a pattern, density, or volume of the spray of water. The spray adjuster 52 may comprise a disc 54, which is engaged to and selectively rotatable relative to the terminus 40 of the second section 34. The disc 54 has a plurality of openings 56 positioned therein. Each opening 56 is selectively alignable with a respective aperture 42 to alter the characteristic of the spray of water. The present invention anticipates the spray adjuster 52 comprising other adjustment means known to those 12 skilled in the art of spray heads.

The assembly 10 may comprise a conduit 58 and a T-fitting 60. The conduit 58 has a first terminus 62, which is configured to be fluidically coupled to the tank 18 of the toilet 20. The T-fitting 60 has an inlet port 64, which is configured to be mountable to a water pipe proximate to the tank 18 of the toilet 20. The T-fitting 60 has a first outlet port 66, which is configured to engage the first end 14 of the hose 12 to fluidically couple the hose 12 to the water pipe. The T-fitting 60 has a second outlet port 68, which is configured to engage a second terminus 70 of the conduit 58 to fluidically couple the conduit 58 to the water pipe.

The assembly 10 also may comprise a head supply valve 72 and a tank supply valve 74. The head supply valve 72 is engaged to the first outlet port 66 and is engageable to the first end 14 of the hose 12. The head supply valve 72 thus is configured to control a pressure of water that is supplied from the water pipe to the spray head 22. The tank supply valve 74 is engaged to the second outlet port 68 and is engageable to the second terminus 70 of the conduit 58. The tank supply valve 74 thus is configured to control a pressure of water that is supplied from the water pipe to the tank 18 of the toilet 20.

A wall 76 is coupled to the shell 28 and is positioned in the interior space 30 to define a reservoir 78. The reservoir 78 is configured to position a fluid, such as a liquid soap solution. The shell 28 has an orifice 80 positioned therein that opens into the reservoir 78. The orifice 80 is configured to add the fluid to the reservoir 78. A cap 82 is selectively engageable to the shell 28 to close the orifice 80.

A flow valve 84 engaged to the wall 76. A fluid actuator 86 is coupled to the shell 28 and is operationally coupled to the flow valve 84. The fluid actuator 86 is positioned to selectively actuate the flow valve 84 to dispense the fluid into the water that is flowing through the interior space 30.

A bulb 88 is coupled to the shell 28 and is configured to selectively illuminate an area proximate to the shell 28. The bulb 88 comprises a light emitting diode 104. The bulb 88 allows a user to illuminate an area of the body, or a surface proximate to the toilet 20, that is being cleansed with spray from the spray head 22.

A dryer module 90 is coupled to the shell 28 and is configured to selectively warm and to blow air into the exit chamber 48 so that the air exits the apertures 42. The dryer module 90 is operationally coupled to the selector valve 44 so that the flow actuator 50 is positioned to selectively fluidically couple the dryer module 90 to the exit chamber 48. The selector valve 44 allows the user to select one of the dryer module 90 and the entry chamber 46 to be in fluidic communication with the exit chamber 48. The dryer module 90 allows the user to direct warm air from the spray head 22 onto the area of the body that has been cleansed to dry the area. The dryer module 90 may comprise a heating element 92 and a blower 94, as shown in FIG. 4.

Figure 4:
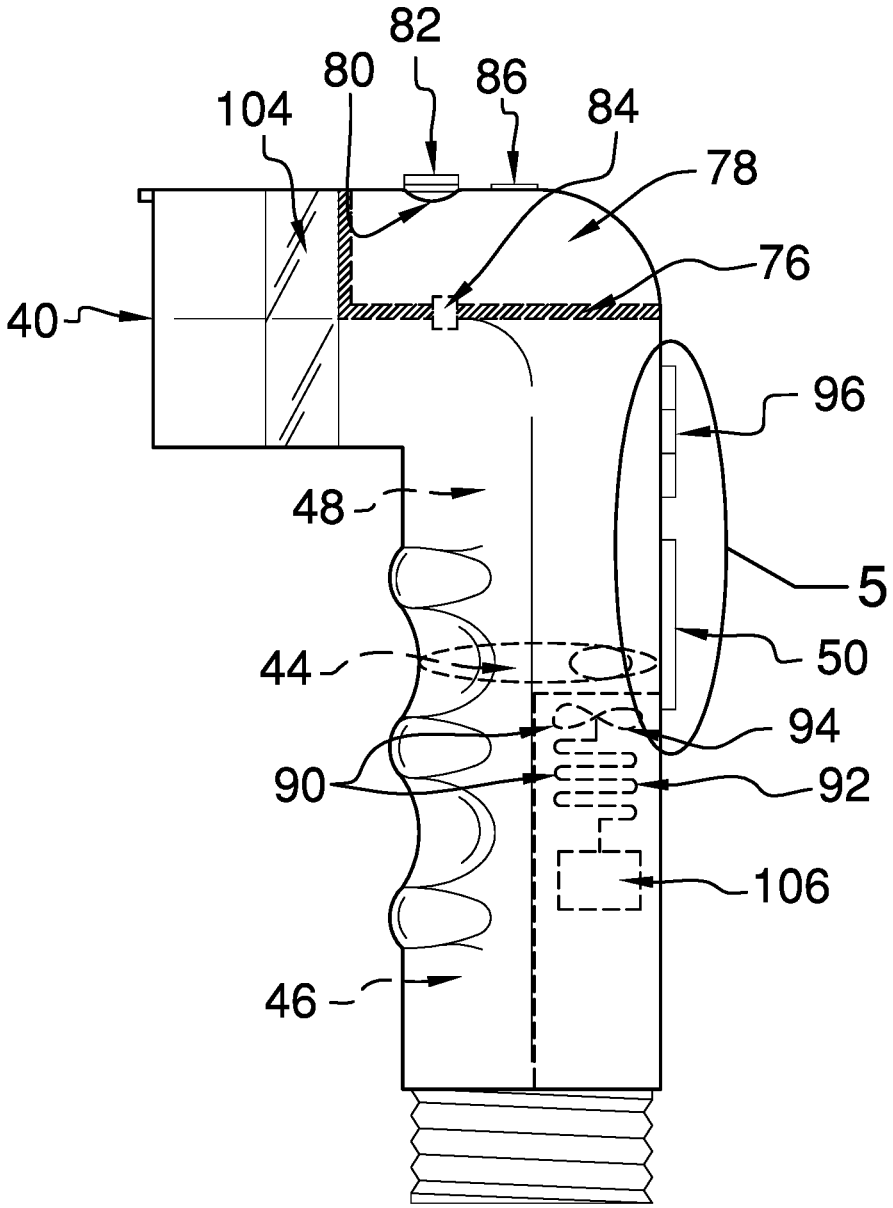
FIG. 4 is a side view of an embodiment of the disclosure.
Figure 5:
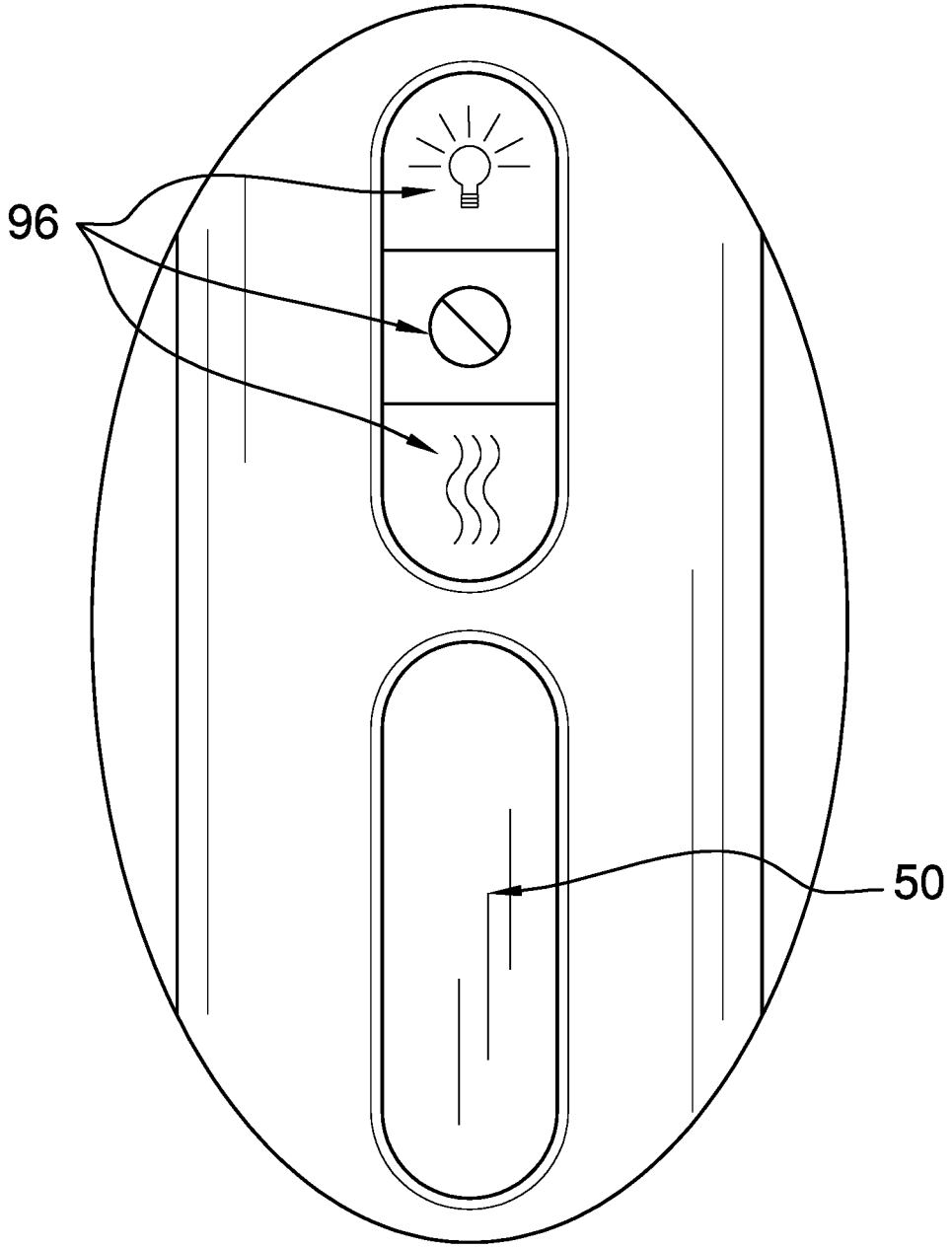
FIG. 5 is a detail view of an embodiment of the disclosure.

The bulb 88 and the dryer module 90 may be powered by a battery 106, as shown in FIG. 4. The present invention also anticipates the bulb 88 and the dryer module 90 being powered by an electrical circuit (not shown).

A controller 96 is coupled to the shell 28 and is operationally coupled to the bulb 88 and the dryer module 90. The controller 96 is positioned to selectively actuate the bulb 88, to illuminate the area proximate to the spray head 22, and the dryer module 90.

Figure 2:
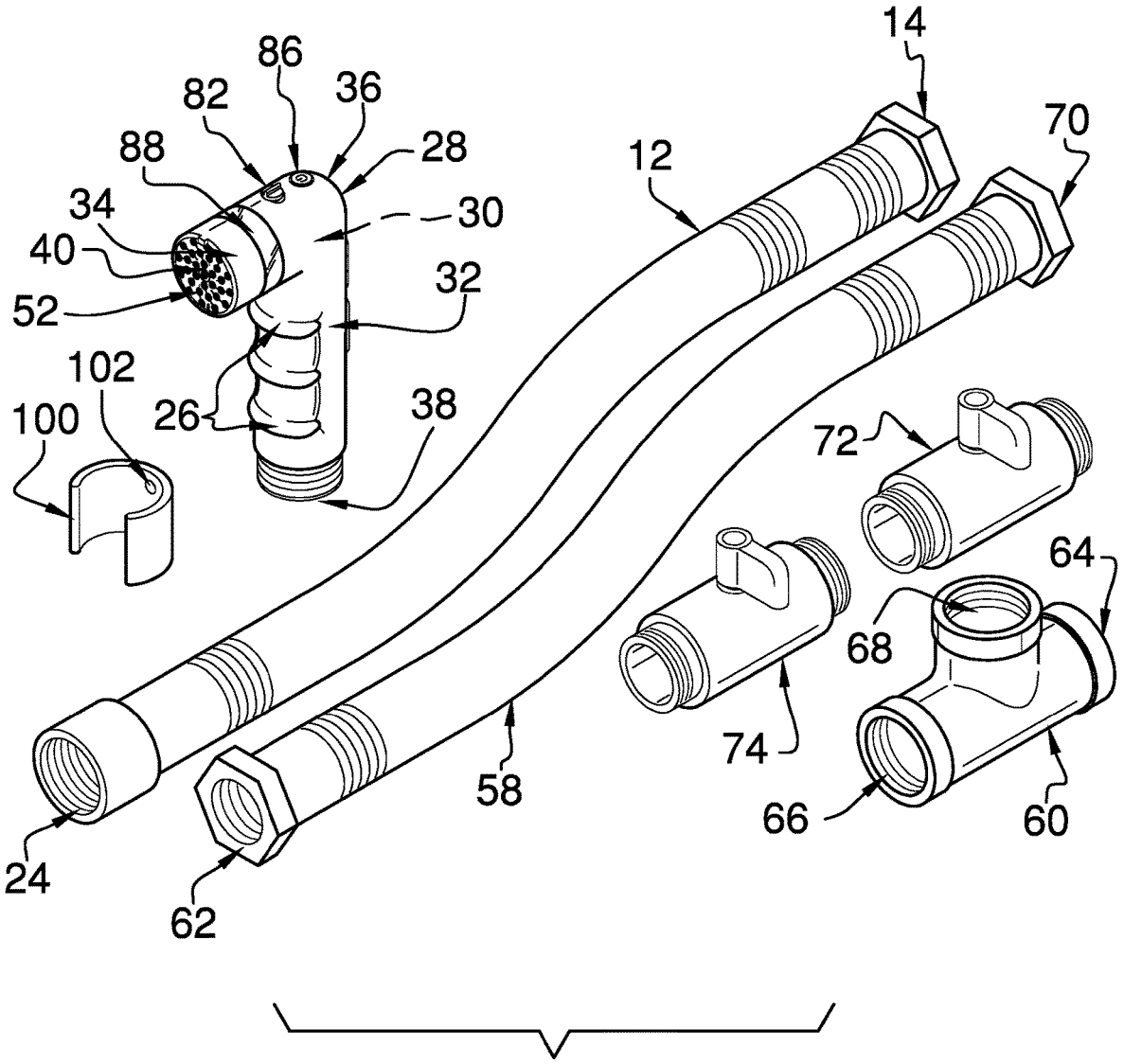
FIG. 2 is an exploded view of an embodiment of the disclosure.

The assembly 10 also may comprise fastener 98, which is configured to be mountable to a surface proximate to the toilet 20 and to selectively engage to the hose 12. The fastener 98 allows the user to stow the hose 12 when not the hose 12 is not in use. The fastener 98 may comprise a clamp 100, as shown in FIG. 2, which has a hole 102 positioned therein. The hole 102 is configured for insertion of an article of mounting hardware (not shown), such as a screw, to mount the fastener 98 to a surface proximate to the toilet 20. The present invention anticipates the fastener 98 comprising other fastening means, such as, but not limited to, hooks, magnets, and the like. The present invention also anticipates other mounting means for mounting the fastener 98 to the surface, such as, but not limited to, suction cups, adhesives, and the like.

In use, the T-fitting 60 is engaged to the water pipe. The head supply valve 72 and the tank supply valve 74 are engaged to the first outlet port 66 and the second outlet port 68, respectively. The first end 14 of the hose 12 is engaged to the head supply valve 72, and the spray head 22 is coupled to the second end 24 of the hose 12. The second terminus 70 of the conduit 58 is engaged to the second outlet port 68 and the first terminus 62 of the conduit 58 is coupled to the tank 18. The fluid, such as the liquid soap, is added to the reservoir 78, positioning the user to utilize the spray head 22 to first cleanse and then to rinse genitalia and anal regions of the user's body. If desired, the heating module can be actuated, using the controller 96, allowing the user to direct warm air onto the genitalia and the anal regions of the user's body to dry the regions. The assembly 10 also can be utilized to clean the toilet 20 and surfaces proximate to the toilet 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A handheld sprayer assembly comprising:

a hose having a first end and a second end, the first end of the hose being configured to be fluidically coupled to a water supply line supplying water to a tank of a toilet;

a spray head coupled to the second end of the hose;

a selector valve positioned in the spray head defining an entry chamber and an exit chamber within an interior space;

a flow actuator engaged to the spray head and operationally coupled to the selector valve, wherein the spray head is configured for grasping in a hand of a user positioning the user for selectively actuating the flow actuator for actuating the selector valve, such that water passes from the entry chamber into the exit chamber and is sprayed from the spray head;

wherein the spray head comprises a shell defining the interior space, the shell being tubular;

wherein the shell comprises a first section and a second section, the second section extending substantially perpendicularly from the first section proximate to a first endpoint of the first section;

wherein the second section has a terminus distal from the first section, the terminus having a plurality of apertures positioned therein, wherein the apertures are configured for generating a spray of water from water passing through the interior space;

wherein the first section has a second endpoint configured to be fluidically coupled to the second end of the hose; and a spray adjuster positioned in the second section and being configured for selectively altering a characteristic of a spray of water from the spray head, wherein the spray adjuster comprises a disc engaged to and selectively rotatable relative to the terminus of the second section of the shell, the disc having a plurality of openings positioned therein such that each opening is selectively alignable with a respective aperture.

2. The handheld sprayer assembly of claim 1, further including a grip coupled to the spray head wherein the grip is configured for enhancing a grasp of the hand of the user upon the spray head.

3. The handheld sprayer assembly of claim 1, further including:

a conduit having a first terminus and a second terminus, the first terminus being configured to be fluidically coupled to the tank of the toilet; and a T-fitting having an inlet port configured to be mountable to a water pipe proximate to the tank of the toilet, the T-fitting having a first outlet port configured for engaging the first end of the hose for fluidically coupling the hose to the water pipe, the T-fitting having a second outlet port configured for engaging the second terminus of the conduit for fluidically coupling the conduit to the water pipe.

4. The handheld sprayer assembly of claim 3, further including a head supply valve engaged to the first outlet port and engageable to the first end of the hose wherein the head supply valve is configured for controlling a pressure of water supplied from the water pipe to the spray head.

5. The handheld sprayer assembly of claim 3, further including a tank supply valve engaged to the second outlet port and engageable to the second terminus of the conduit wherein the tank supply valve is configured for controlling a pressure of water supplied from the water pipe to the tank of the toilet.

6. The handheld sprayer assembly of claim 1, further including:

a wall coupled to the shell and positioned in the interior space defining a reservoir, the reservoir being configured for positioning a fluid;

the shell having an orifice positioned therein and opening into the reservoir wherein the orifice is configured for adding the fluid to the reservoir;

a cap selectively engageable to the shell for closing the orifice;

a flow valve engaged to the wall; and a fluid actuator coupled to the shell and operationally coupled to the flow valve such that the fluid actuator is positioned for selectively actuating the flow valve for dispensing the fluid into the water flowing through the interior space.

7. The handheld sprayer assembly of claim 1, further including a bulb coupled to the shell and being configured for selectively illuminating an area proximate to the shell.

8. The handheld sprayer assembly of claim 7, wherein the bulb comprises a light emitting diode.

9. The handheld sprayer assembly of claim 7, further including a dryer module coupled to the shell and being configured for selectively warming and blowing air into the exit chamber such that the air exits the apertures, the dryer module being operationally coupled to the selector valve such that the selector valve is positioned for selectively and fluidically coupling the dryer module to the exit chamber.

10. The handheld sprayer assembly of claim 9, further including a controller coupled to the shell and being operationally coupled to the bulb and the dryer module such that the controller is positioned for selectively actuating the bulb and the dryer module.

11. The handheld sprayer assembly of claim 1, further including a fastener configured to be mountable to a surface proximate to the toilet and for selectively engaging to the hose.

12. A toilet and handheld sprayer assembly combination comprising:

a toilet comprising a tank and a bowl;

a hose having a first end and a second end, the first end of the hose being configured to be fluidically coupled to a water supply line supplying water to the tank;

a spray head coupled to the second end of the hose;

a selector valve positioned in the spray head defining an entry chamber and an exit chamber within an interior space; and a flow actuator engaged to the spray head and operationally coupled to the selector valve, wherein the spray head is configured for grasping in a hand of a user positioning the user for selectively actuating the flow actuator for actuating the selector valve, such that water passes from the entry chamber into the exit chamber and is sprayed from the spray head;

the spray head comprising a shell defining the interior space, the shell being tubular, the shell comprising a first section and a second section, the second section extending substantially perpendicularly from the first section proximate to a first endpoint of the first section, the second section having terminus distal from the first section, the terminus having a plurality of apertures positioned therein, wherein the apertures are configured for generating a spray of water from water passing through the interior space, the first section having a second endpoint configured to be fluidically coupled to the second end of the hose; and a spray adjuster positioned in the second section and being configured for selectively altering a characteristic of a spray of water from the spray head, the spray adjuster comprising a disc engaged to and selectively rotatable relative to the terminus of the second section of the shell, the disc having a plurality of openings positioned therein such that each opening is selectively alignable with a respective aperture.

13. The toilet and handheld sprayer assembly combination of claim 12, further including:

a conduit having a first terminus and a second terminus, the first terminus being configured to be fluidically coupled to the tank of the toilet; and a T-fitting having an inlet port configured to be mountable to a water pipe proximate to the tank of the toilet, the T-fitting having a first outlet port configured for engaging the first end of the hose for fluidically coupling the hose to the water pipe, the T-fitting having a second outlet port configured for engaging the second terminus of the conduit for fluidically coupling the conduit to the water pipe;

a head supply valve engaged to the first outlet port and engageable to the first end of the hose wherein the head supply valve is configured for controlling a pressure of water supplied from the water pipe to the spray head; and a tank supply valve engaged to the second outlet port and engageable to the second terminus of the conduit wherein the tank supply valve is configured for controlling a pressure of water supplied from the water pipe to the tank of the toilet.

14. The toilet and handheld sprayer assembly combination of claim 12, further including:

a wall coupled to the shell and positioned in the interior space defining a reservoir, the reservoir being configured for positioning a fluid;

the shell having an orifice positioned therein and opening into the reservoir wherein the orifice is configured for adding the fluid to the reservoir;

a cap selectively engageable to the shell for closing the orifice;

a flow valve engaged to the wall; and a fluid actuator coupled to the shell and operationally coupled to the flow valve such that the fluid actuator is positioned for selectively actuating the flow valve for dispensing the fluid into the water flowing through the interior space.

15. The toilet and handheld sprayer assembly combination of claim 12, further including:

a bulb coupled to the shell and being configured for selectively illuminating an area proximate to the shell, the bulb comprising a light emitting diode;

a dryer module coupled to the shell and being configured for selectively warming and blowing air into the exit chamber such that the air exits the apertures, the dryer module being operationally coupled to the selector valve such that the selector valve is positioned for selectively and fluidically coupling the dryer module to the exit chamber; and a controller coupled to the shell and being operationally coupled to the bulb and the dryer module such that the controller is positioned for selectively actuating the bulb and the dryer module.

16. A handheld sprayer assembly comprising:

a hose having a first end and a second end, the first end of the hose being configured to be fluidically coupled to a water supply line supplying water to a tank of a toilet;

a spray head coupled to the second end of the hose, the spray head comprising a shell defining an interior space, the shell being tubular, the shell comprising a first section and a second section, the second section extending substantially perpendicularly from the first section proximate to a first endpoint of the first section, the second section having terminus distal from the first section, the terminus having a plurality of apertures positioned therein, wherein the apertures are configured for generating a spray of water from water passing through the interior space, the first section having a second endpoint configured to be fluidically coupled to the second end of the hose;

a spray adjuster positioned in the second section and being configured for selectively altering a characteristic of a spray of water from the spray head, the spray adjuster comprising a disc engaged to and selectively rotatable relative to the terminus of the second section of the shell, the disc having a plurality of openings positioned therein such that each opening is selectively alignable with a respective aperture;

a selector valve positioned in the spray head defining an entry chamber and an exit chamber within the interior space;

a flow actuator engaged to the spray head and operationally coupled to the selector valve, wherein the spray head is configured for grasping in a hand of a user positioning the user for selectively actuating the flow actuator for actuating the selector valve, such that water passes from the entry chamber into the exit chamber and is sprayed from the spray head;

a grip coupled to the spray head wherein the grip is configured for enhancing a grasp of the hand of the user upon the spray head;

a conduit having a first terminus and a second terminus, the first terminus being configured to be fluidically coupled to the tank of the toilet;

a T-fitting having an inlet port configured to be mountable to a water pipe proximate to the tank of the toilet, the T-fitting having a first outlet port configured for engaging the first end of the hose for fluidically coupling the hose to the water pipe, the T-fitting having a second outlet port configured for engaging the second terminus of the conduit for fluidically coupling the conduit to the water pipe;

a head supply valve engaged to the first outlet port and engageable to the first end of the hose wherein the head supply valve is configured for controlling a pressure of water supplied from the water pipe to the spray head;

a tank supply valve engaged to the second outlet port and engageable to the second terminus of the conduit wherein the tank supply valve is configured for controlling a pressure of water supplied from the water pipe to the tank of the toilet;

a wall coupled to the shell and positioned in the interior space defining a reservoir, the reservoir being configured for positioning a fluid, the shell having an orifice positioned therein and opening into the reservoir wherein the orifice is configured for adding the fluid to the reservoir;

a cap selectively engageable to the shell for closing the orifice;

a flow valve engaged to the wall;

a fluid actuator coupled to the shell and operationally coupled to the flow valve such that the fluid actuator is positioned for selectively actuating the flow valve for dispensing the fluid into the water flowing through the interior space;

a bulb coupled to the shell and being configured for selectively illuminating an area proximate to the shell, the bulb comprising a light emitting diode;

a dryer module coupled to the shell and being configured for selectively warming and blowing air into the exit chamber such that the air exits the apertures, the dryer module being operationally coupled to the selector valve such that the selector valve is positioned for selectively and fluidically coupling the dryer module to the exit chamber;

a controller coupled to the shell and being operationally coupled to the bulb and the dryer module such that the controller is positioned for selectively actuating the bulb and the dryer module; and a fastener configured to be mountable to a surface proximate to the toilet and for selectively engaging to the hose.

* * * * *